US009127631B2

(12) United States Patent
Petrone et al.

(10) Patent No.: US 9,127,631 B2
(45) Date of Patent: Sep. 8, 2015

(54) FUEL PUMP FOR A DIRECT INJECTION SYSTEM

(75) Inventors: Michele Petrone, San Lazzaro di Savena (IT); Enrico Vezzani, Bologna (IT); Massimo Mattioli, Calderara di Reno (IT)

(73) Assignee: MAGNETI MARELLI S.P.A., Corbetta (IT)

( * ) Notice: Subject to any disclaimer, the term of this patent is extended or adjusted under 35 U.S.C. 154(b) by 1096 days.

(21) Appl. No.: 13/108,369

(22) Filed: May 16, 2011

(65) Prior Publication Data

US 2012/0012084 A1 Jan. 19, 2012

(30) Foreign Application Priority Data

May 17, 2010 (IT) ..... BO2010A0309

(51) Int. Cl.

| | |
|---|---|
| ***F04B 53/16*** | (2006.01) |
| ***F02M 59/46*** | (2006.01) |
| ***F02M 59/06*** | (2006.01) |
| ***F02M 59/48*** | (2006.01) |
| ***F04B 1/04*** | (2006.01) |

(52) U.S. Cl.

CPC ..... *F02M 59/462* (2013.01); *F02M 59/06* (2013.01); *F02M 59/48* (2013.01); *F04B 1/0421* (2013.01); *F04B 53/162* (2013.01)

(58) Field of Classification Search

CPC ..... F04B 17/05; F04B 1/0421; F04B 53/162; F02M 39/005; F02M 39/02; F02M 59/462; F02M 59/06; F02M 59/048; B23K 5/00; B23K 9/00

USPC ..... 417/364, 470, 471; 123/495, 468

See application file for complete search history.

(56) References Cited

U.S. PATENT DOCUMENTS

| | | | | |
|---|---|---|---|---|
| 5,564,908 | A * | 10/1996 | Phillips et al. | 417/273 |
| 6,092,426 | A | 7/2000 | Vollenweider et al. | |
| 6,289,875 | B1 * | 9/2001 | Shinohara et al. | 123/450 |
| 6,698,399 | B1 * | 3/2004 | Grabert | 123/456 |
| 2009/0097997 | A1 * | 4/2009 | Suzuki et al. | 417/470 |

FOREIGN PATENT DOCUMENTS

| | | |
|---|---|---|
| DE | 10322595 A1 | 12/2004 |
| DE | 10353314 A1 | 6/2005 |

(Continued)

OTHER PUBLICATIONS

Italian Search Report.

*Primary Examiner* — Devon Kramer
*Assistant Examiner* — Nathan Zollinger
(74) *Attorney, Agent, or Firm* — Howard & Howard Attorneys PLLC

(57) ABSTRACT

A fuel pump for a direct injection system provided with a common rail; the fuel pump has: at least one pumping chamber defined in a main body; a piston which 5 is mounted sliding inside the pumping chamber; a suction channel connected to the pumping chamber and regulated by a suction valve; a delivery channel connected to the pumping chamber and regulated by a delivery valve; and a high pressure connection, which is welded by a ring weld 10 to a wall of the main body at the delivery channel, has the function of allowing a connection to a supply duct that feeds the fuel under pressure to the common rail, and has internally a passing through channel through which the fuel coming from the delivery channel flows 15 towards the supply duct.

26 Claims, 5 Drawing Sheets

(56) References Cited

FOREIGN PATENT DOCUMENTS

| | | | | |
|---|---|---|---|---|
| DE | 10361573 | A | * | 7/2005 |
| DE | 10361573 | A1 | | 7/2005 |
| DE | 102004015440 | A1 | | 10/2005 |
| EP | 0994250 | A2 | | 4/2000 |
| JP | 2006046138 | A | * | 2/2006 |

* cited by examiner

FUEL PUMP FOR A DIRECT INJECTION SYSTEM

CROSS-REFERENCE TO RELATED APPLICATION

This application claims priority under 35 U.S.C. §119 to Italian Patent Application No. B02010A-000309, filed on May 17, 2010 with the Italian Patent and Trademark Office, the disclosure of which is incorporated herein in its entirety by reference.

TECHNICAL FIELD

The present invention relates to a fuel pump for a direct injection system.

PRIOR ART

A direct injection system comprises a plurality of injectors, a common rail which feeds fuel under pressure to the injectors, a high pressure pump, which feeds the fuel to the common rail by means of a high pressure fuel supply duct and is provided with a flow rate regulating device, and a control unit, which drives the flow rate regulating device to maintain the fuel pressure within the common rail equal to a desired value, generally variable over time according to the operating conditions of the engine.

The high pressure pump (e.g. of the type described in patent application IT2009BO00197) comprises at least one pumping chamber, within which a piston runs with reciprocating motion, a suction duct regulated by a suction valve for feeding low pressure fuel into the pumping chamber, and a delivery duct regulated by a delivery valve for feeding high pressure fuel from the pumping chamber and to the common rail through the supply duct.

The high pressure pump described in patent application IT2009BO00197 comprises a high pressure connection, which overhangingly protrudes from a side wall of the pumping chamber and has a threading onto which an end of the high pressure supply duct, which connects the delivery of the high pressure pump to the common rail, is screwed. In order to contain production costs, the high pressure connection is made separately and then welded by means of a ring weld to the side wall of the pumping chamber at the delivery duct. However, it has been observed that the ring weld which connects the high pressure connection to the side wall of the pumping chamber is subjected to considerable mechanical stresses, which may cause fatigue failure over time. In use, the fuel pressure downstream of the delivery valve, and thus within the high pressure connection, inevitably pulsates at a frequency typically comprised from 3 to 250 Hz, and thus determines a similar pulsation of the mechanical stresses to which the high pressure connection is subjected. Furthermore, the high pressure connection in use is also subjected to mechanical stresses which are generated by the vibrations of the engine and are also of the pulsating type.

Patent application DE10322595A1 describes a fuel pump for a direct injection system comprising: a pumping chamber defined in a main body; a piston which is mounted slidingly inside the pumping chamber to cyclically vary the volume of the pumping chamber; a suction channel connected to the pumping chamber and regulated by a suction valve; a delivery channel connected to the pumping chamber and regulated by a delivery valve; and a high pressure connection, which is welded by a ring weld to a wall of the main body at the delivery channel, has the function of allowing a connection to a supply duct that feeds the fuel under pressure to the common rail, and internally has a passing through channel through which the fuel coming from the delivery channel flows towards the supply duct.

DESCRIPTION OF THE INVENTION

It is the object of the present invention to provide a fuel pump for a direct injection system, which fuel pump is free from the above-described drawbacks and which at the same time is easy and cost-effective to make.

According to the present invention, a fuel pump for a direct injection system is made as disclosed in the appended claims.

BRIEF DESCRIPTION OF THE DRAWINGS

The present invention will now be described with reference to the accompanying drawings, which illustrate some non-limitative embodiments thereof, in which.

PREFERRED EMBODIMENTS OF THE INVENTION

Figure 1:
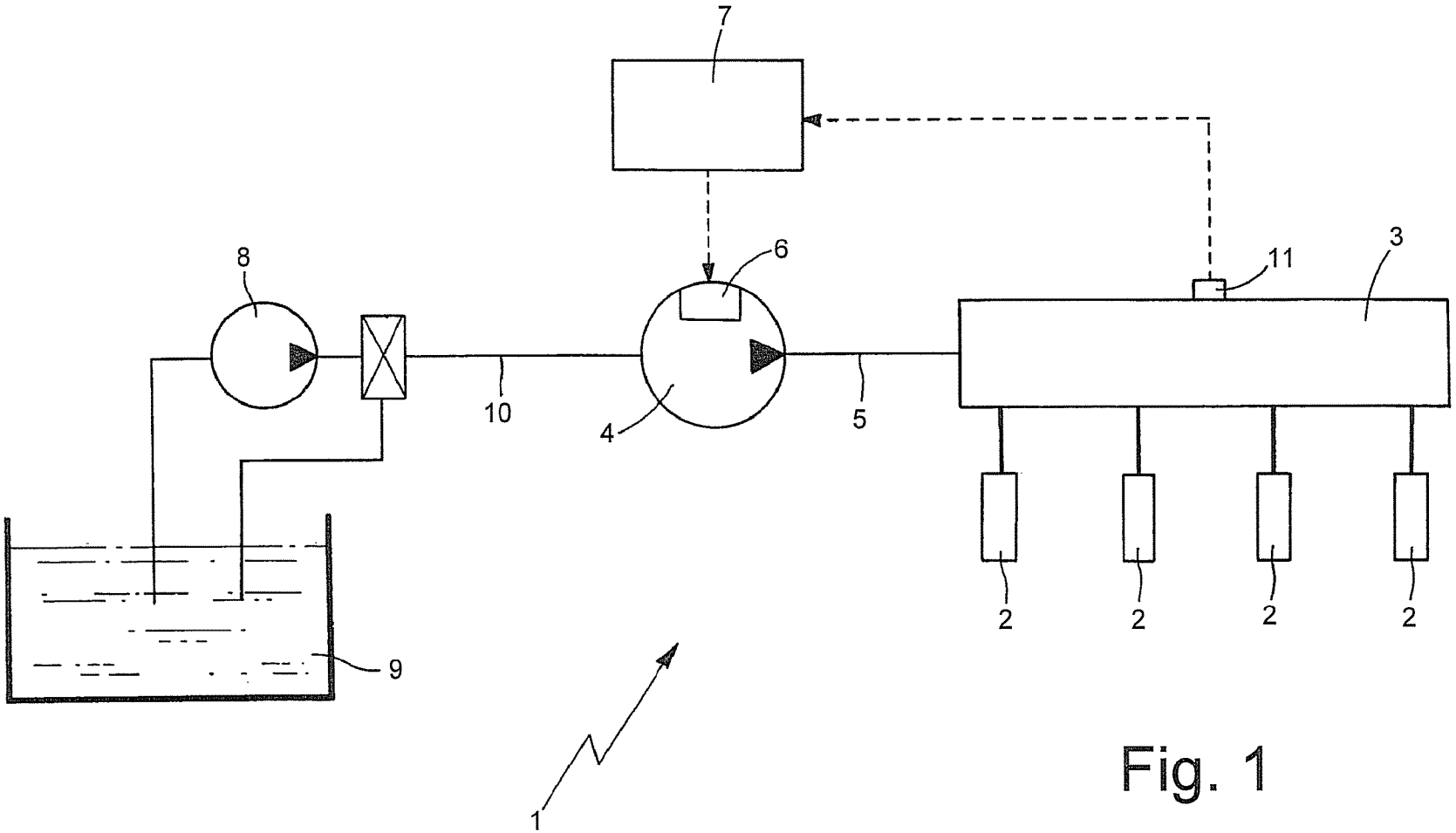
FIG. 1 is a diagrammatic view with parts removed for clarity of a direct fuel injection system of the common rail type.

In FIG. 1, numeral 1 indicates as a whole a direct fuel injection system of the common rail type for an internal combustion thermal engine.

The direct injection system 1 comprises a plurality of injectors 2, a common rail 3, which feeds fuel under pressure to the injectors 2, a high pressure pump 4, which feeds the fuel to the common rail 3 by means of a supply duct 5 and is provided with a flow rate regulating device, a control unit 7, which maintains the pressure of the fuel in the common rail 3 equal to a desired value, generally variable over time according to the operating conditions of the engine, and a low pressure pump 8, which feeds the fuel from a tank 9 to the high pressure pump 4 by means of a supply duct 10.

The control unit 7 is coupled to the regulating device 6 to control the flow rate of the high pressure pump 4 so as to feed the amount of fuel needed to obtain the desired fuel pressure in the common rail 3 instant-by-instant to the common rail 3 itself; in particular, the control unit 7 regulates the flow rate of the high pressure pump 4 by means of a feedback control using the fuel pressure inside the common rail 3, which pressure value is detected in real time by a pressure sensor 11, as feedback variable.

Figure 2:
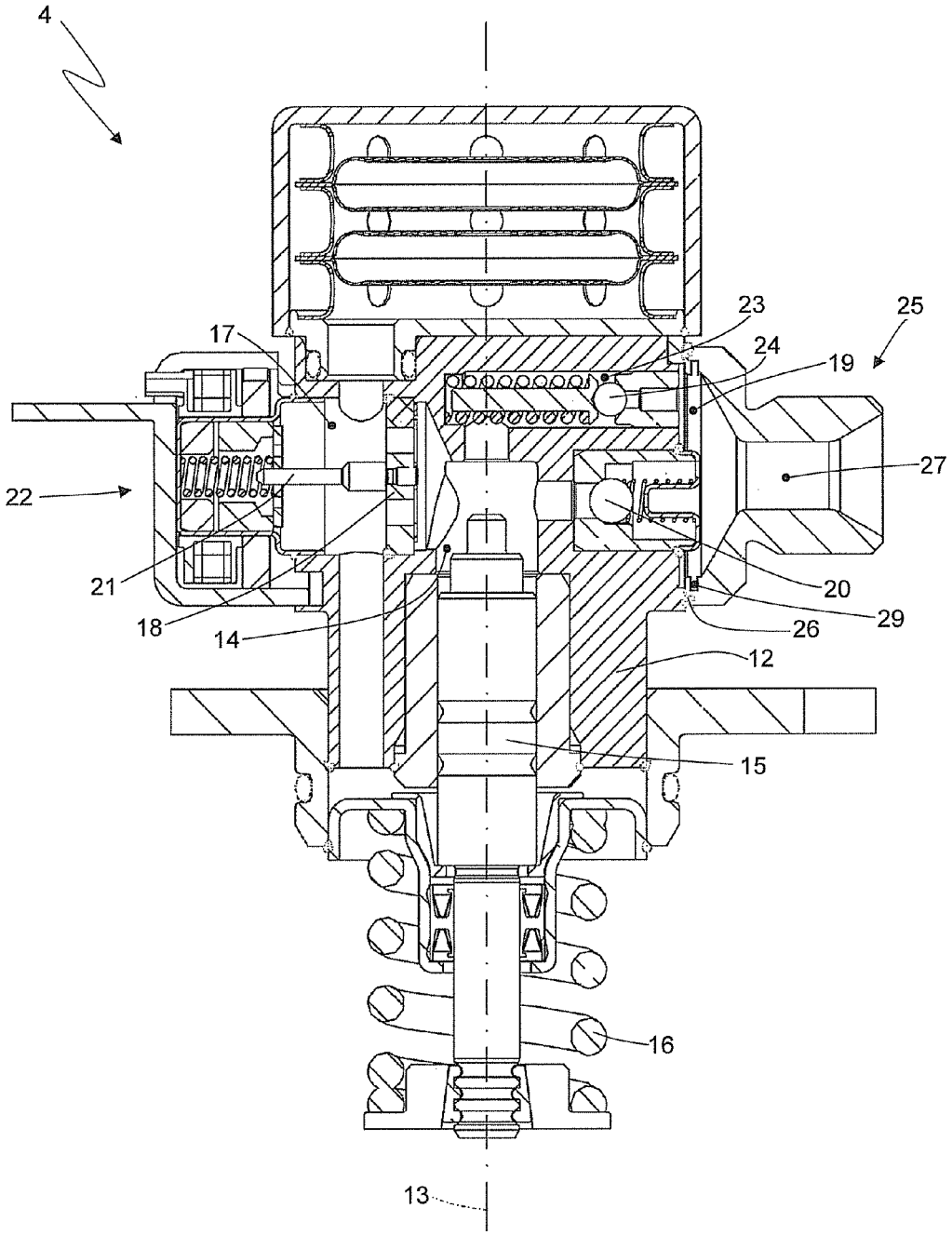
FIG. 2 is a diagrammatic, section view, with parts removed for clarity, of a high pressure fuel pump of the direct injection system in FIG. 1.

As shown in FIG. 2, the high pressure pump 4 comprises a main body 12, which has a longitudinal axis 13 and defines a cylindrical shape pumping chamber 14 therein. A piston 15 is mounted sliding in the pumping chamber 14, which piston by moving with reciprocating motion along the longitudinal axis 13 determines a cyclical variation of the volume of the pumping chamber 14. A lower portion of the piston 15 is coupled on one side to a spring 16, which tends to push the piston 15 towards a maximum volume position of the pumping chamber and on the other side is coupled to a cam (not shown), which is rotably fed by a driving shaft of the engine to cyclically move the piston 15 upwards, thus compressing the spring 16.

A suction duct 17, which is connected to the low pressure pump 8 by means of the supply duct 10, originates from a side wall of the pumping chamber 14 and is regulated by a suction valve 18 disposed at the pumping chamber 14. The suction valve 18 is normally pressure-controlled and in absence of external interventions the suction valve 18 is closed when the fuel pressure in the pumping chamber 14 is higher than the fuel pressure in the suction duct 17 and is open when the fuel pressure in the pumping chamber 14 is lower than the fuel pressure in the suction duct 17.

A delivery duct 19, which is connected to the common rail 3 by means of the supply duct 5 and is regulated by a one-way delivery valve 20, which is disposed at the pumping chamber 14 and exclusively allows a fuel flow outgoing from the pumping chamber 14, originates from a side wall of the pumping chamber 14, from the side opposite to the suction duct 17. The delivery valve 20 is pressure-controlled and open when the fuel pressure in the pumping chamber 14 is higher than the fuel pressure in the delivery duct 19 and is closed when the fuel pressure in the pumping chamber 14 is lower than the fuel pressure in the delivery duct 19.

The regulating device 6 is coupled to the suction valve 18 to allow the control unit 7 to maintain the suction valve 18 open during the step of pumping of piston 15, and thus allow a fuel flow outgoing from the pumping chamber 14 through the suction duct 17. The regulating device 6 comprises a control rod 21, which is coupled to the suction valve 18 and is mobile between a passive position, in which it allows the suction valve 18 to close, and an active position, in which it does not allow the suction valve 18 to close. The regulating device 6 further comprises an electromagnetic actuator 22, which is coupled to the control rod 21 to move the control rod 21 between the active position and the passive position.

A discharge duct 23, which puts the pumping chamber in communication with the delivery duct 19 and is regulated by a one-way maximum pressure valve 24, which exclusively allows a fuel flow ingoing to the pumping chamber 14 only, originates from an upper wall of the pumping chamber 14. The function of the maximum pressure valve 24 is to allow release of fuel if the fuel pressure in the common rail 3 exceeds a maximum value predetermined in the step of designing (typically in the case of errors in the control carried out by the control unit 7); in other words, the maximum pressure valve 24 is automatically calibrated when the pressure drop at its terminals is higher than a threshold value established during the step of designing, and thus prevents the fuel pressure in the common rail 3 from exceeding the maximum value established during the step of designing.

A high pressure connection 25 is welded by a ring weld 26 to a side wall of the main body 12 (in which the pumping chamber 14 is defined) at the delivery channel 19. The high pressure connection 25 is a cylindrical symmetry, internally hollow, tubular body, which has the function of allowing a stable, fluid-tight mechanical connection between the high pressure pump 4 and the supply duct 5 that feeds the fluid under pressure into the common channel 3. A passing through channel 27 is defined within the high pressure connection 25, through which channel the fuel from the delivery duct 19 flows to the supply duct 5. A threading 28 (shown in FIG. 3) is obtained on the outer surface of the high pressure connection 25 on which the supply duct 5 is fluid-tightly screwed.

Figure 3:
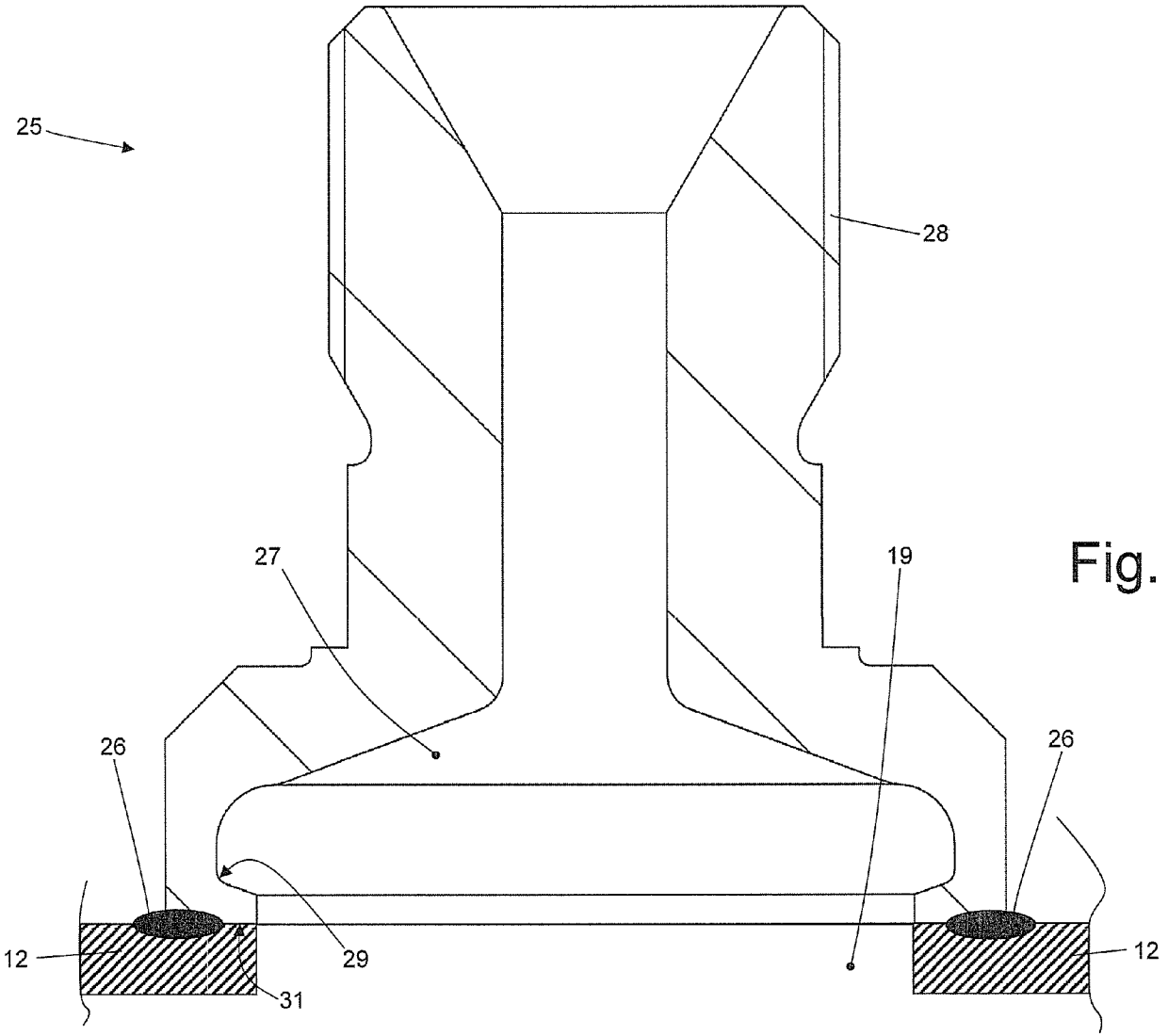
FIG. 3 is a view on enlarged scale of a high pressure connection which overhangingly protrudes from a side wall of a pumping chamber of the high pressure fuel pump in FIG. 2.
Figure 4:
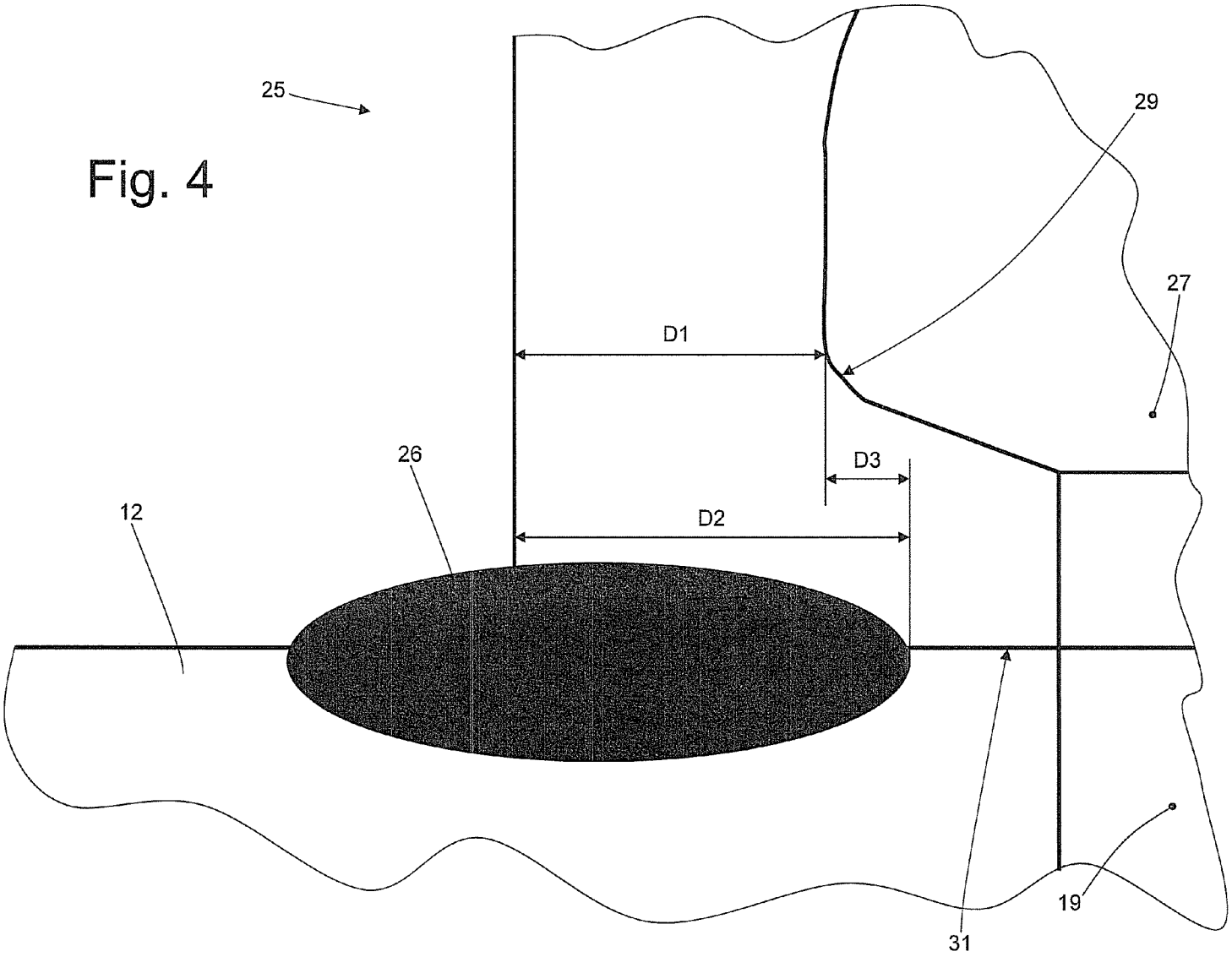
FIG. 4 is an enlarged scale view of a detail of the high pressure connection in FIG. 3.

As shown in FIGS. 3 and 4, the passing through channel 27 of the high pressure connection 25 comprises a ring groove 29, which is obtained through a side wall of the passing through channel 27 (i.e. inside the high pressure connection 25), and is disposed in proximity of the ring weld 26 (i.e. at a distance of no more than 2-4 mm from the ring weld 26), and extends from the side wall of the passing through channel 27 towards the ring weld 26.

As shown in FIG. 4, a distance D1 existing between a bottom of the ring groove 29 and an outer surface of the side wall of the high pressure connection 25 is similar (i.e. has approximately the same value) to a distance D2 existence between a inner end of the ring weld 26 and the outer surface of the side wall of the high pressure connection 25; in particular, the absolute value of the difference D3 between distance D1 and distance D2 is less than 35% of the distance D1 and/or of the distance D2. In numerical terms, the absolute value of the difference D3 between distance D1 and distance D2 is less than 0.5 mm (and, according to a preferred embodiment, is less than 0.3 mm).

According to a preferred embodiment shown in the attached figures, distance D2 is higher than or equal to distance D1, i.e. the ring groove 29, in radial direction, partially overlaps the ring groove 26 (in other words, the axial projection of the ring groove 29 crosses the ring weld 26).

Figure 5:
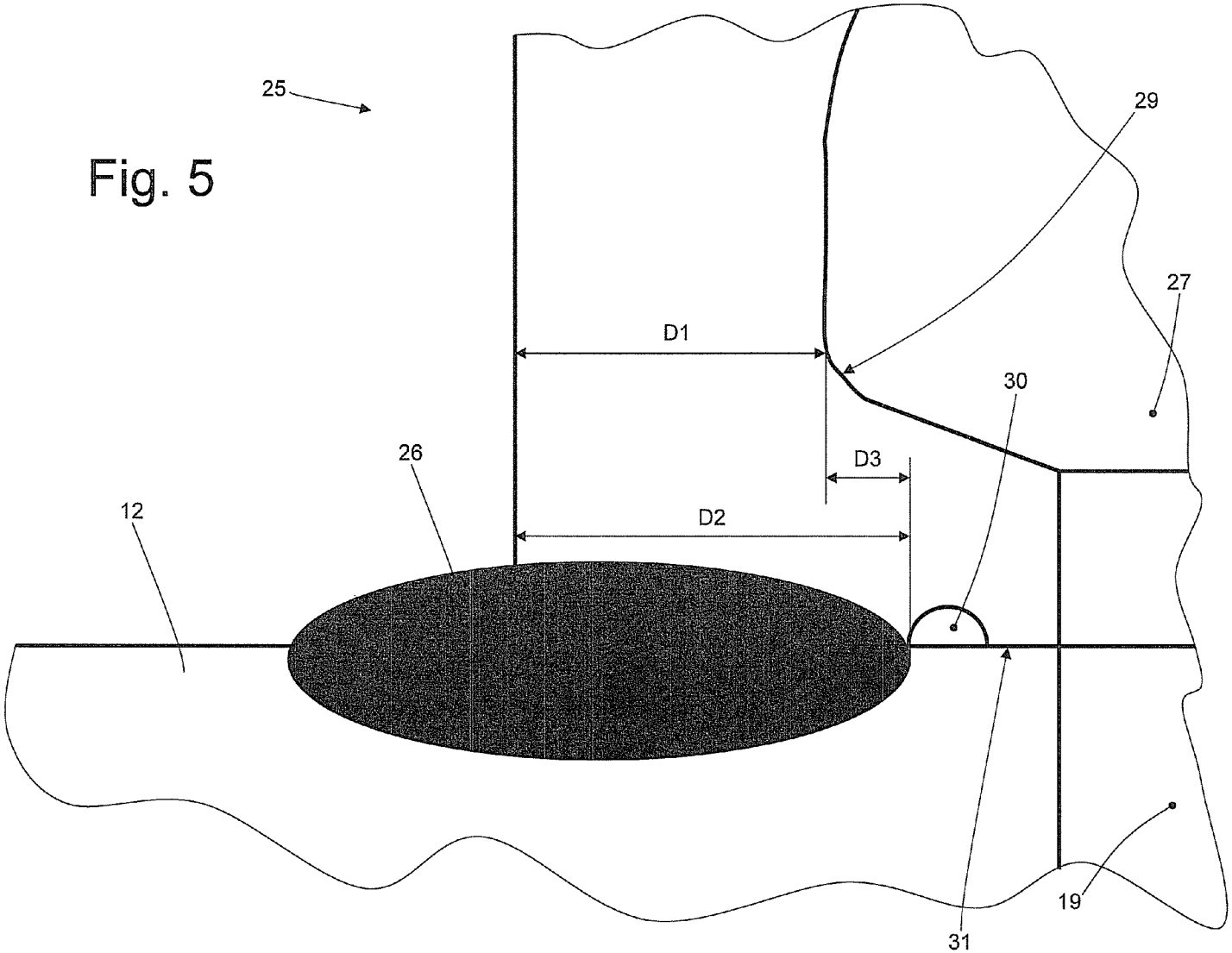
FIG. 5 is a constructive variant of the detail of the high pressure connection in FIG. 4.

According to a preferred embodiment shown in FIG. 5, a further ring groove 30 is contemplated, which is obtained on a lower side 31 of the high pressure connection 25 disposed in contact with the side wall of the main body 12. An outer edge of the ring groove 30 obtained on the lower wall 31 of the high pressure connection 25 is disposed at the inner end of the ring weld 26, i.e. is disposed at distance D2 from the outer surface of the side wall of the high pressure connection 25. The function of the ring groove 30 is to improve the quality and repeatability of the ring weld 26, because it establishes a precise, physical limit for the inner end of the ring weld 26. In other words, it is complicated to obtain the exact positioning of the ring weld 26 (and, in particular, the exact positioning of the inner end of the ring weld 26) with high accuracy; for solving such a problem, a ring groove 30 is used, which by establishing an accurate, physical limit for the inner end of the ring weld 26 allows to accurately position the inner end of the ring weld 26 itself.

It has been observed that by virtue of the presence of the ring groove 29, the mechanical stresses present at the apex of the ring weld 26 (i.e. at the inner end of the ring weld 26) and generated by the fuel pressure inside the passing through channel 27 are reduced by approximately 30-40% with respect to a similar configuration of the high pressure connection 25 free from the ring groove 29. Such a result is obtained by virtue of the fact that by effect of the presence of the ring groove 29 the distribution of the strains at the apex of the ring weld 26 (the most critical zone, because failure due to fatigue starts in this zone) is considerably reduced; in particular, at the ring groove 29, the pressure of the fuel in the passing through channel 27 generates on the high pressure connection 25 a force which pushes the high pressure connection 25 against the side wall of the main body 12 and which thus "helps" the ring weld 26 to maintain the high pressure connection 25 in contact with the side wall of the main body 12.

The higher the reduction of mechanical stresses present at the apex of the ring weld 26, the greater the superimposition of the ring groove 29 and the ring weld 26 (i.e. the greater the distance D2 from the distance D1, i.e. the greater the difference D3 between distance D2 and distance D1, the deeper the ring groove 29). The superimposition limit between the ring groove 29 and the ring weld 26 (i.e. the limit of the depth of the ring groove 29) is determined by the mechanical resistance of the side wall of the high pressure connection 25: the distance D1 existing between the bottom of the ring groove 29 and the outer surface of the side wall of the high pressure connection 25 (i.e. the minimum thickness of the side wall of the high pressure connection 25) cannot be too small in order not to influence negatively the mechanical strength of the side wall of the high pressure connection 25 (which must withstand the fuel pressure inside the through passage channel 27).

The high pressure pump 4 described above has many advantages.

Firstly, in the high pressure pump 4 described above the ring weld 26 has definitely less mechanical stresses than a similar configuration of the high pressure connection 25 free from the ring groove 29.

Furthermore, the high pressure pump 4 described above is simple and cost-effective to implement, because the ring grove 29 in the passing through channel 27 and the ring groove 30 on the lower wall 31 of the high pressure connection 25 are made by means of simple material removal mechanical operations.

The invention claimed is:

1. A fuel pump for a direct injection system provided with a common rail; the fuel pump comprises:

at least one pumping chamber defined in a main body;

a piston which is mounted sliding inside the pumping chamber to vary cyclically the volume of the pumping chamber;

a suction channel connected to the pumping chamber and regulated by a suction valve;

a delivery channel connected to the pumping chamber and regulated by a delivery valve; and a high pressure connection, which presents a lower wall placed in contact with a wall of the main body, is connected by a ring weld to the wall of the main body in correspondence of the delivery channel, allows for connecting to a supply duct that feeds fuel under pressure to the common rail, and has innerly a passing through channel through which fuel coming from the delivery channel flows towards the supply duct;

wherein the passing through channel comprises a first ring groove, which is obtained through a side wall of the high pressure connection, is disposed in the vicinity of the ring weld, and extends from the side wall of the high pressure connection towards the ring weld;

wherein the first ring groove presents a U-shaped cross-section and is spaced-apart from the lower wall of the high pressure connection so that the side wall of the high pressure connection is thicker at the lower wall than at the first ring groove; and wherein a first distance between a bottom of the first ring groove and an outer surface of the side wall of the high pressure connection is about equal to a second distance between an inner end of the ring weld and the outer surface of the side wall of the high pressure connection.

2. The fuel pump according to claim 1, wherein the absolute difference between the first distance and the second distance is less than 35% of the first distance and/or of the second distance.

3. The fuel pump according to claim 1, wherein the absolute difference between the first distance and the second distance is less than 0.5 mm.

4. The fuel pump according to claim 1, wherein the absolute difference between the first distance and the second distance is less than 0.3 mm.

5. The fuel pump according to claim 1, wherein the second distance is greater than or equal to the first distance.

6. The fuel pump according to claim 1, wherein the first ring groove is, in the radial direction, partially superimposed on the ring weld.

7. The fuel pump according to claim 1, wherein the high pressure connection comprises a second ring groove which is obtained on the lower wall of the high pressure connection placed in contact with the wall of the main body.

8. The fuel pump according to claim 7, wherein an outer edge of the second ring groove is disposed in correspondence of an inner end of the ring weld.

9. The fuel pump according to claim 8, wherein the inner end of the ring weld touches the outer edge of the second ring groove.

10. A fuel pump for a direct injection system provided with a common rail; the fuel pump comprises:

at least one pumping chamber defined in a main body;

a piston which is mounted sliding inside the pumping chamber to vary cyclically the volume of the pumping chamber;

a suction channel connected to the pumping chamber and regulated by a suction valve;

a delivery channel connected to the pumping chamber and regulated by a delivery valve; and a high pressure connection, which is connected by a ring weld to a wall of the main body in correspondence of the delivery channel, allows for connecting to a supply duct that feeds fuel under pressure to the common rail, and has innerly a passing through channel through which fuel coming from the delivery channel flows towards the supply duct;

wherein the passing through channel comprises a first ring groove, which is obtained through a side wall of the high pressure connection, is disposed in the vicinity of the ring weld, and extends from the side wall of the high pressure connection towards the ring weld;

wherein the first ring groove is, in the radial direction, partially superimposed on the ring weld; and wherein the high pressure connection comprises a second ring groove which is obtained on a lower wall of the high pressure connection placed in contact with the wall of the main body.

11. The fuel pump according to claim 10, wherein a first distance between a bottom of the first ring groove and an outer surface of the side wall of the high pressure connection is about equal to a second distance between an inner end of the ring weld and the outer surface of the side wall of the high pressure connection.

12. The fuel pump according to claim 11, wherein the absolute difference between the first distance and the second distance is less than 35% of the first distance and/or of the second distance.

13. The fuel pump according to claim 11, wherein the absolute difference between the first distance and the second distance is less than 0.5 mm.

14. The fuel pump according to claim 11, wherein the absolute difference between the first distance and the second distance is less than 0.3 mm.

15. The fuel pump according to claim 11, wherein the second distance is greater than or equal to the first distance.

16. The fuel pump according to claim 10, wherein an outer edge of the second ring groove is disposed in correspondence of an inner end of the ring weld.

17. The fuel pump according to claim 16, wherein the inner end of the ring weld touches the outer edge of the second ring groove.

18. A fuel pump for a direct injection system provided with a common rail; the fuel pump comprises:

at least one pumping chamber defined in a main body;

a piston which is mounted sliding inside the pumping chamber to vary cyclically the volume of the pumping chamber;

a suction channel connected to the pumping chamber and regulated by a suction valve;

a delivery channel connected to the pumping chamber and regulated by a delivery valve; and a high pressure connection, which is connected by a ring weld to a wall of the main body in correspondence of the delivery channel, allows for connecting to a supply duct that feeds fuel under pressure to the common rail, and has innerly a passing through channel through which fuel coming from the delivery channel flows towards the supply duct;

wherein the passing through channel comprises a first ring groove, which is obtained through a side wall of the high pressure connection, is disposed in the vicinity of the ring weld, and extends from the side wall of the high pressure connection towards the ring weld; and wherein the high pressure connection comprises a second ring groove which is obtained on a lower wall of the high pressure connection placed in contact with the wall of the main body.

19. The fuel pump according to claim 18, wherein a first distance between a bottom of the first ring groove and an outer surface of the side wall of the high pressure connection is about equal to a second distance between an inner end of the ring weld and the outer surface of the side wall of the high pressure connection.

20. The fuel pump according to claim 19, wherein the absolute difference between the first distance and the second distance is less than 35% of the first distance and/or of the second distance.

21. The fuel pump according to claim 19, wherein the absolute difference between the first distance and the second distance is less than 0.5 mm.

22. The fuel pump according to claim 19, wherein the absolute difference between the first distance and the second distance is less than 0.3 mm.

23. The fuel pump according to claim 19, wherein the second distance is greater than or equal to the first distance.

24. The fuel pump according to claim 18, wherein the first ring groove is, in the radial direction, partially superimposed on the ring weld.

25. The fuel pump according to claim 18, wherein an outer edge of the second ring groove is disposed in correspondence of an inner end of the ring weld.

26. The fuel pump according to claim 25, wherein the inner end of the ring weld touches the outer edge of the second ring groove.

* * * * *